US005829357A

United States Patent [19]

Coppens

[11] Patent Number: 5,829,357

[45] Date of Patent: Nov. 3, 1998

[54] GUIDANCE SYSTEM COMPRISING A RAIL AND A GROOVED ROLLER

[75] Inventor: Luc Coppens, Brussels, Belgium

[73] Assignee: Bombardier Eurorail, S.A., Brugge, Belgium

[21] Appl. No.: 849,093

[22] PCT Filed: Nov. 16, 1995

[86] PCT No.: PCT/BE95/00105

§ 371 Date: Jul. 23, 1997

§ 102(e) Date: Jul. 23, 1997

[87] PCT Pub. No.: WO96/17129

PCT Pub. Date: Jun. 6, 1996

[30] Foreign Application Priority Data

Nov. 28, 1994 [BE] Belgium ..... 9401075

[51] Int. Cl.[6] ..... E01B 25/28

[52] U.S. Cl. ..... 105/72.2; 104/243; 180/401; 238/122

[58] Field of Search ..... 104/118, 243, 104/245; 105/72.2, 141, 163.1, 163.22; 180/401; 238/122, 125, 148

[56] References Cited

U.S. PATENT DOCUMENTS

| | | | |
|---|---|---|---|
| 2,619,290 | 11/1952 | Thomson | 238/125 |
| 2,717,739 | 9/1955 | Burkhardt et al. | 238/125 |
| 3,180,280 | 4/1965 | Kuch et al. | 104/245 |
| 3,730,103 | 5/1973 | Weaver | 104/245 |
| 4,355,578 | 10/1982 | Raquet | 104/306 |
| 4,454,819 | 6/1984 | Cuylits et al. | 104/245 |

FOREIGN PATENT DOCUMENTS

| | | | |
|---|---|---|---|
| 425257 | 12/1937 | Belgium . | |
| 060000 | 9/1983 | European Pat. Off. . | |
| 328564 | 1/1903 | France . | |
| 1082511 | 5/1960 | Germany | 104/243 |
| 8800544 | 1/1988 | WIPO . | |

*Primary Examiner*—S. Joseph Morano

*Attorney, Agent, or Firm*—Sughrue, Mion, Zinn, Macpeak & Seas, PLLC

[57] ABSTRACT

A guidance system for a vehicle designed to follow a two-way track and having pneumatically tired steered wheels coupled to a directional arm. The system includes a rail with a rolled steel section having a head supported on a web strengthened by a lower foot projecting from each side of the web; the head is bounded laterally by receding inclined lateral faces. A grooved roller follows the rail, and floats at an end of the directional arm of the vehicle.

10 Claims, 5 Drawing Sheets

FIG. 1
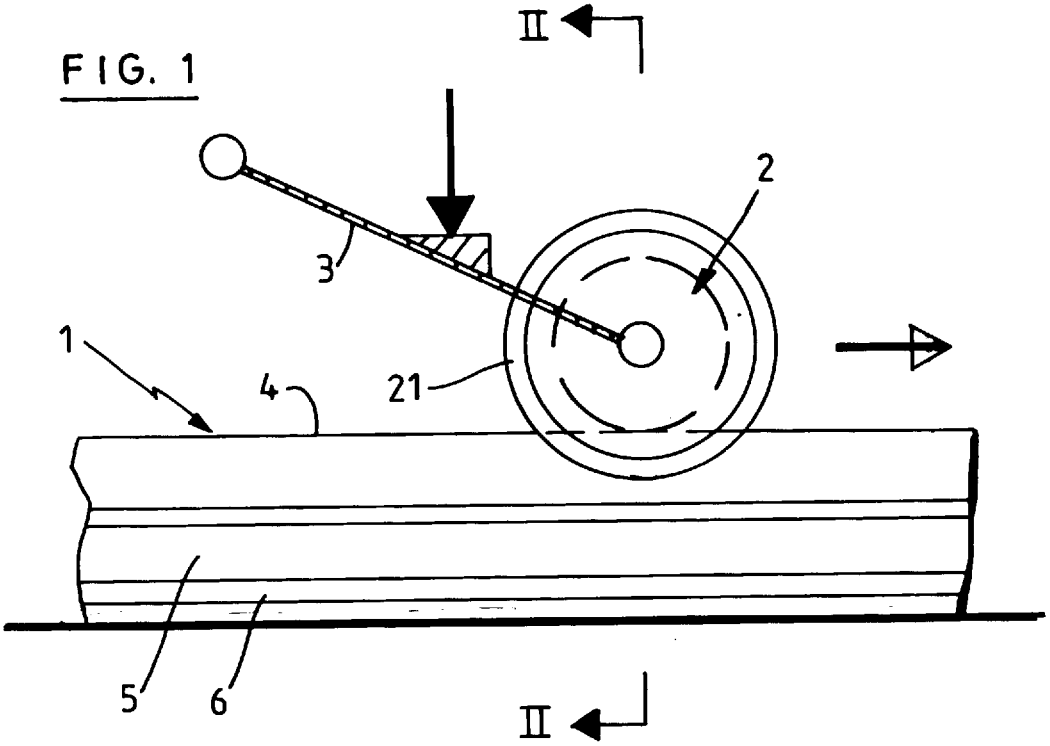
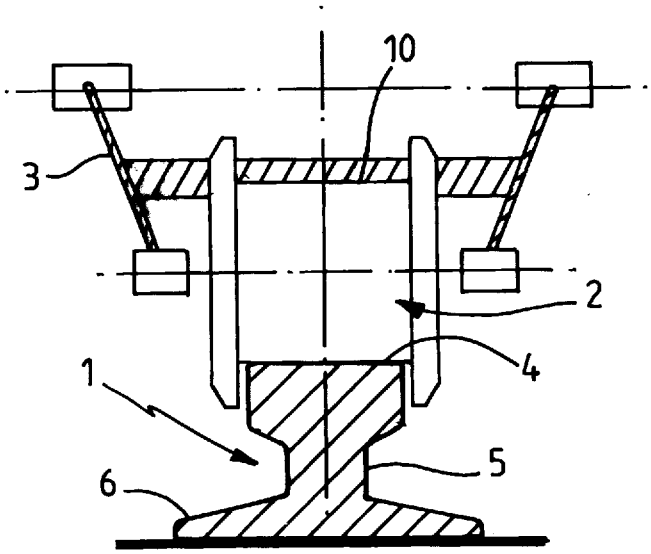
FIG. 2

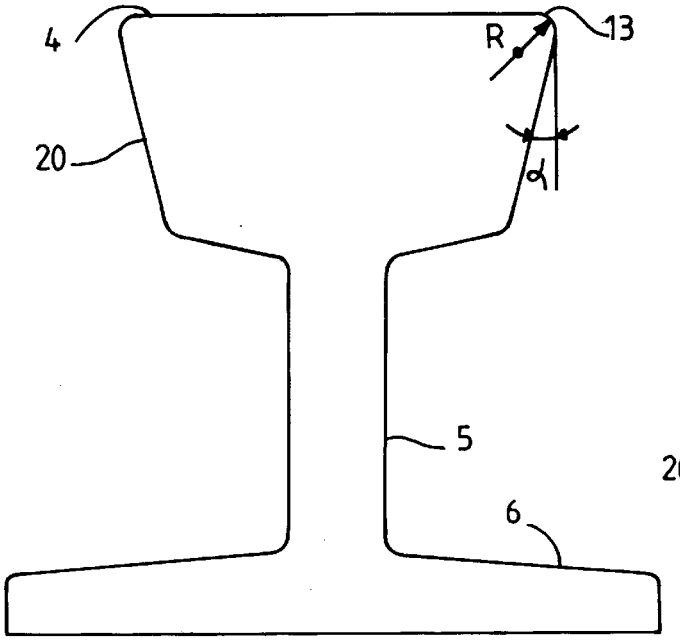
FIG. 7
FIG. 8
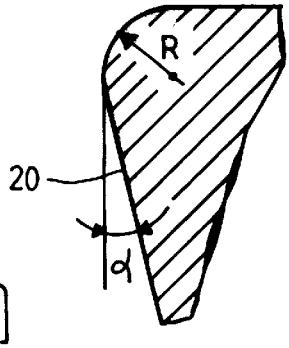
FIG. 10
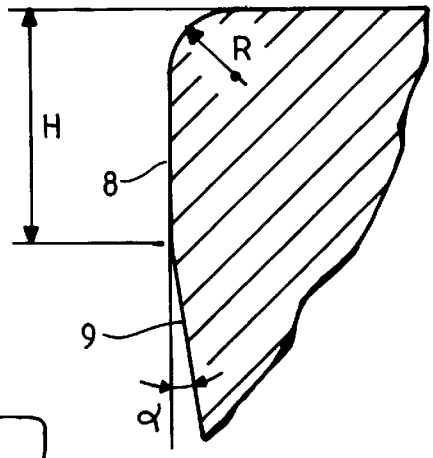
FIG. 9
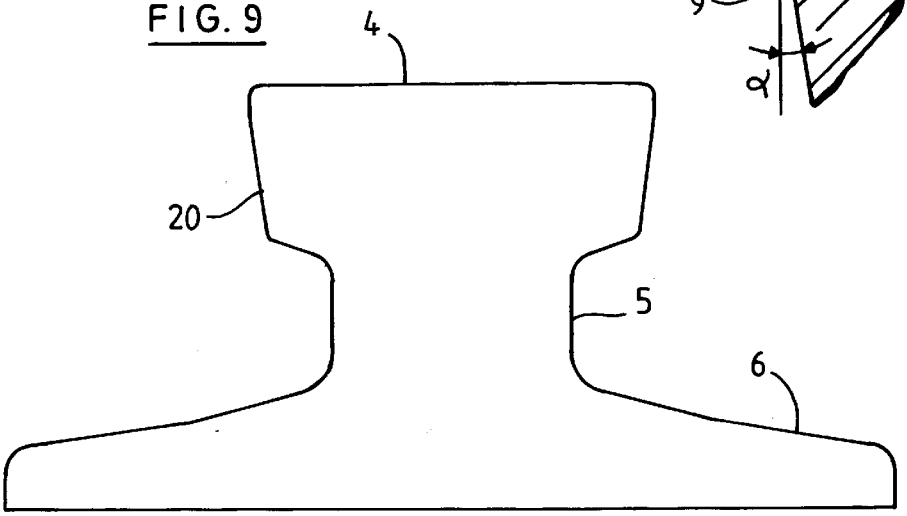

GUIDANCE SYSTEM COMPRISING A RAIL AND A GROOVED ROLLER

BACKGROUND OF THE INVENTION

The present invention relates to a guidance system for a vehicle fitted with steered wheels on pneumatic tires.

Document WO 88/00544 has already disclosed a rapid public transport vehicle that runs on tires and is automatically guided along a predetermined track by a grooved roller that follows a rail. Although no precise description of the rail is given in that document, it can be inferred that the rail is similar to those used for travelling cranes. Such a rail has a horizontal head bounded by vertical lateral faces which meet said head along 2 to 5 mm rounded edges which are inherent in the way the rail is rolled. As for the guide roller, this has a U-section groove defined by the rim of the roller and two flanges, one on either side of the rail.

However, this known rail has certain defects of adhesion and noise that can be explained by careful examination of the complementary forms of the cross-sections of the rail and of the groove of the roller. It will be found that any lateral movement of the roller caused by a sideways swaying of the supporting arm or a curve in the track greater in amplitude than the amount of play between the rail and the roller causes the flange of the roller to strike against the lateral face of the rail. Since the flange of the roller and the lateral face of the rail are both in the same vertical plane, their area of contact coincides with that of a segment of a circle whose radius is equal to the external radius of the flange and whose chord is the generatrix of the rail lying along the lower limit of the rounded edge.

The relative speed of each of the contact points of the roller flange with respect to the rail varies in proportion to the distance which separates it from the instantaneous centre of rotation of the rim of the roller on the head of the rail. Those contact points of the roller that are moving at the fastest relative speeds and are under the greatest contact pressures from the rail will be subject to the severest wear and will produce the greatest part of the unwanted noise.

SUMMARY OF THE INVENTION

The object of the present invention is to solve the abovementioned problems and avoid many other faults connected with the use of a rolling metal-on-metal contact—in particular the risk of derailment and poor adhesion. To this end it provides a rolled rail having a head which comprises receding inclined lateral faces.

The present invention relates to a guidance system for a vehicle fitted with steered wheels on pneumatic tires, comprising a rail and a grooved roller designed to follow the rail, which grooved roller floats at the end of a directional arm coupled to the pneumatically tired steered wheels of the vehicle, which is designed to follow a two-way track.

The directional arm extends parallel to the rail. It points in the direction in which the vehicle is moving, when it carries the roller in front of itself, and there is generally also a second arm pointing in the opposite direction to the direction of movement of the vehicle, in other words a supporting arm pulling a second guide roller as disclosed in European patent No. 0,062,370 by the applicant.

The rail according to the invention finds its main application in rail-guided vehicles designed to run on a two-way track compatible with a normal roadway. The rail is usually let into a channel cut into the road surface or is laid on the surface of the ground in a dedicated site.

The guidance system of the invention for a vehicle, designed to follow a two-way track and comprising pneumatically tired steered wheels coupled to a directional arm, comprises: a rail with a rolled steel section comprising a head supported on a web strengthened by a lower foot projecting from each side of the web, said head being bounded laterally by receding inclined lateral faces; and a grooved roller following the rail, said grooved roller floating at an end of the directional arm of the vehicle.

In accordance with one feature of the invention, the lateral faces of the rail are at an angle of inclination $\alpha$ to the vertical of between 5° and 15°.

In one particular embodiment at least one of the lateral faces includes an upper portion of its surface that is vertical and a lower portion of its surface that is inclined, said two portions of the surface being separated by a generatrix parallel to the rail.

These features and other features and details of the invention will be clear from the following detailed description which refers to the appended drawings showing, by way of a non-restrictive illustrative example, two particular embodiments of the invention.

BRIEF DESCRIPTION OF THE DRAWINGS

In these drawings:

FIG. 1 is a side elevation of a known guide roller carried on a supporting arm which presses it against a known rail;

FIG. 2 is a vertical section on the plane marked II-II' in FIG. 1 of the grooved roller shown in FIG. 1;

FIGS. 7 and 8 illustrate one embodiment of the rail according to the invention;

FIGS. 9 and 10 illustrate a second embodiment of the rail according to the invention.

Figure 3:
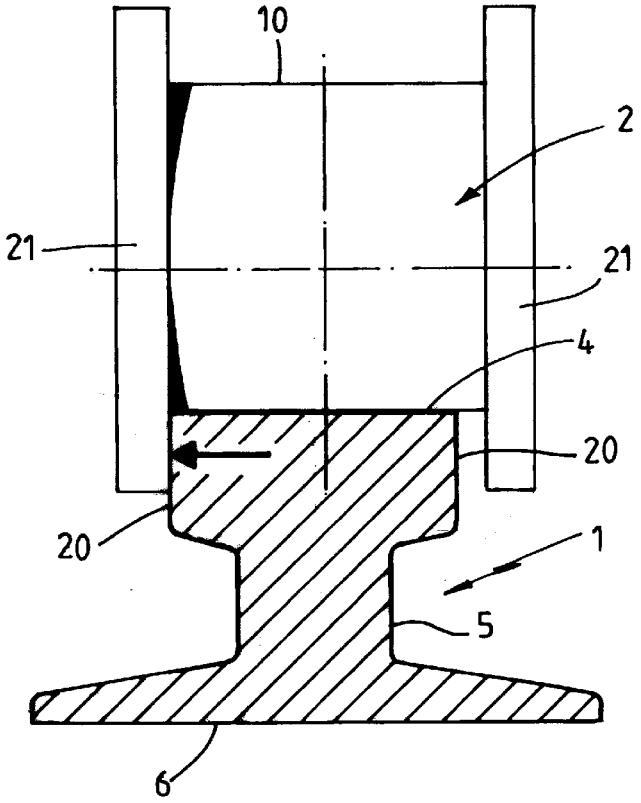
FIGS. 3 and 4 are views similar to FIGS. 1 and 2 on a larger scale.

In these figures, the same reference signs denote identical and/or analogous parts.

DESCRIPTION OF PREFERRED EMBODIMENTS

FIG. 1 shows a side elevation of a floating guide roller 2 mounted at the end of a directional arm 3 of a guidance system of a vehicle fitted with pneumatically tyred steered wheels designed to follow a two-way track. A supporting system (not shown) presses the roller 2 down onto the rail. The rail 1 consists of a rolled steel section comprising a flat or convex head 4 supported by a web 5 which in turn is strengthened by a lower foot 6 that projects from each side of the web 5.

The roller 2 comprises a groove 10 shaped like a straight-sided trough. The groove 10 is bounded by the rim of the roller and two vertical flanges 21 which run along the lateral faces 20 of the rail, as illustrated in FIG. 2.

Figure 4:
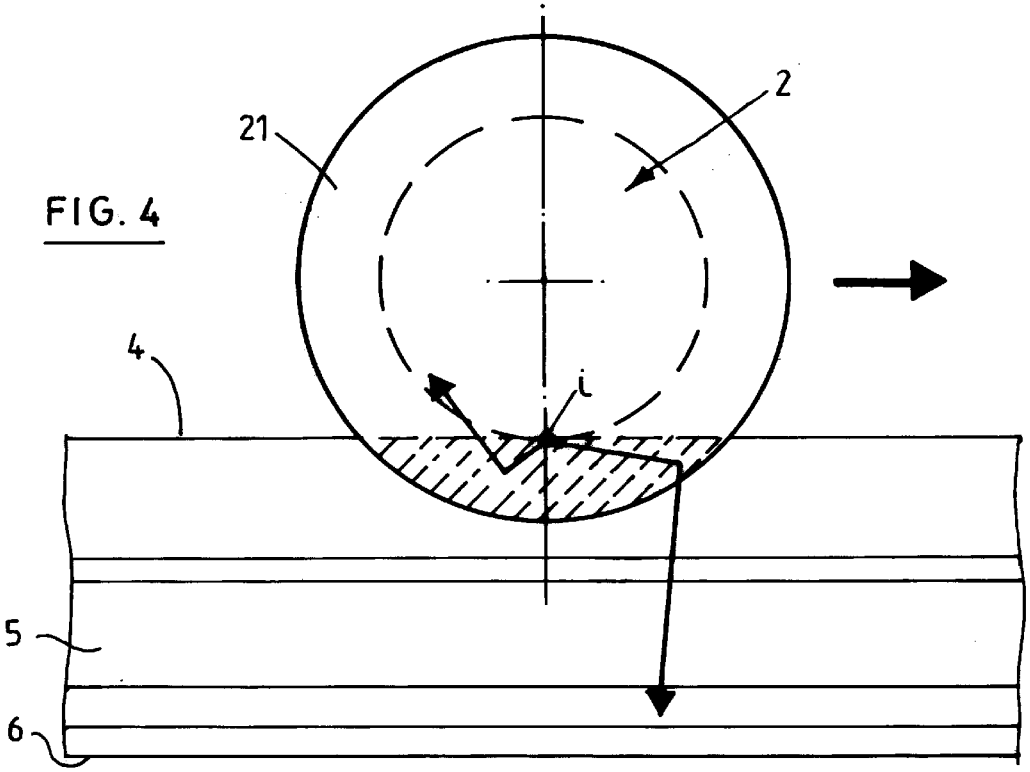
Figure 5:
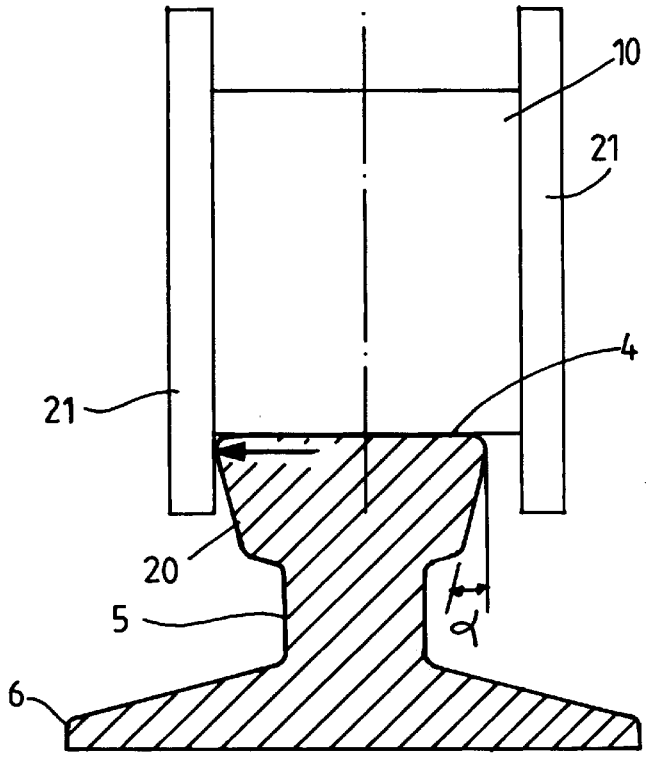
FIGS. 5 and 6 are views similar to FIGS. 3 and 4 of the rail according to the invention.
Figure 6:
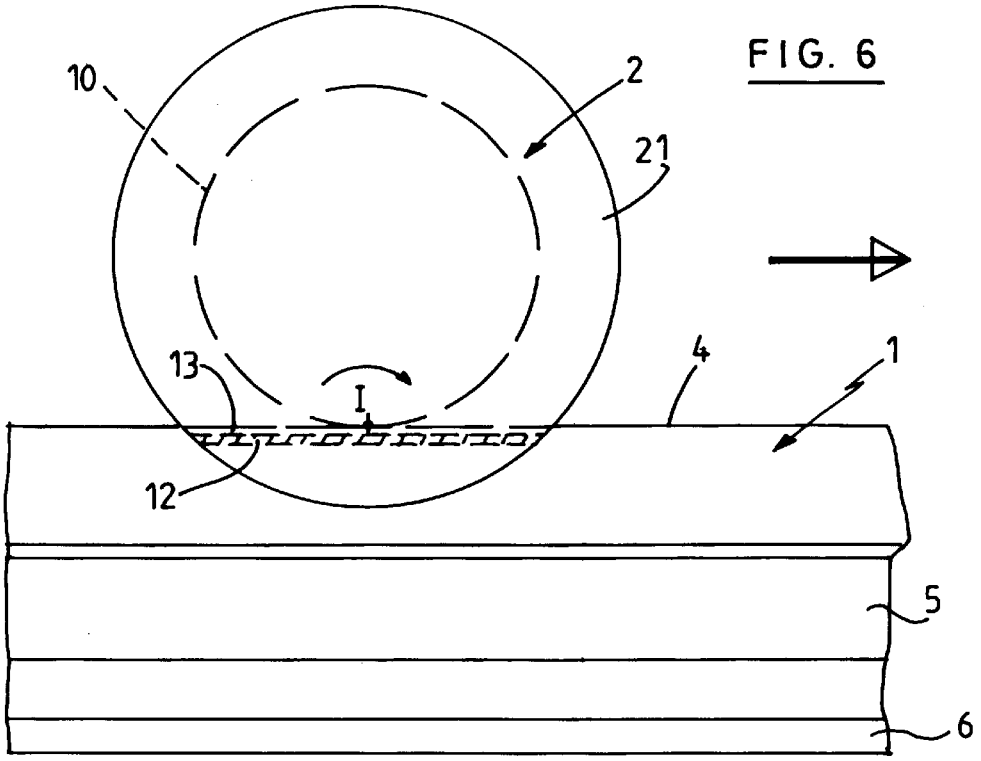

Hitherto the rail regarded as the best for guiding a vehicle of the abovementioned type has been a rail designed for travelling cranes. Such a rail is shown in FIGS. 3 and 4 at the same time as the grooved roller into which it fits. The rail possesses a horizontal head 4 bounded by vertical lateral faces that meet said head along rounded edges with radii of from 2 to 5 mm. Since the flanges 21 of the roller and the lateral faces 20 of the rail 1 are parallel, they touch each other over an area of contact that includes the entire portion of the surface of the flange situated below the rim of the roller when the roller strikes against the rail. As will be appreciated, the contact points remote from the instantaneous center of rotation i of the rim of the roller on the head of the rail 4 are travelling at a high relative speed with respect to the rail. The contact points of the roller whose relative speeds are the highest and where the contact pressure from the rail is the greatest generate the fiercest vibrations and experience the heaviest wear.

In order to reduce the relative speeds of the remote contact points, the present invention provides a guide rail whose head 4 is bounded laterally by receding inclined lateral faces 20. In this way the zones of contact between the flanges 21 of the roller, which lie in vertical plane, and the lateral faces 20 of the rail, which lie in inclined planes, are limited to a very narrow band of contact 12 along the lower limit of each rounded edge 13 that borders each side of the head 4 on which the roller rolls. The angle of inclination 2 of the inclined lateral faces of the rails to the vertical may be, for example, approximately 10°.

Figure 12:
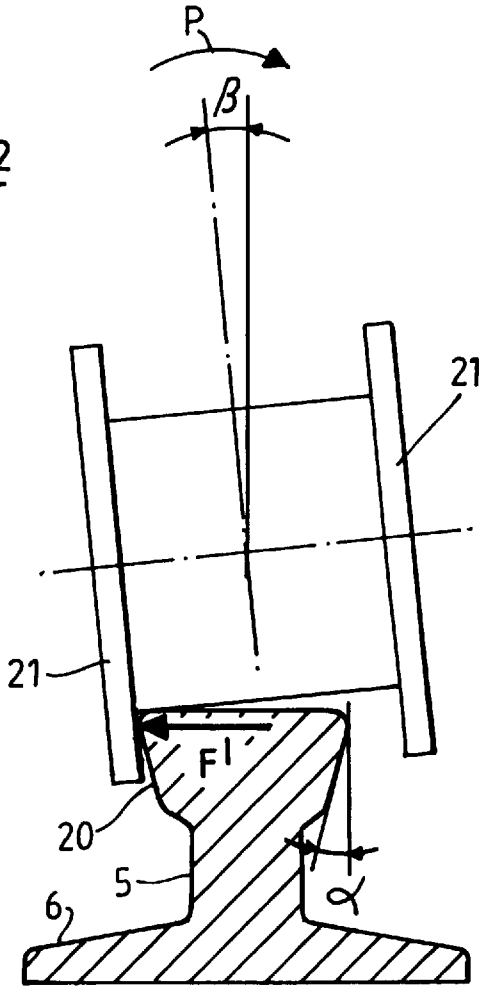
FIGS. 11 and 12 show a roller on a rail according to the invention, and the vertical pivoting of said roller.
Figure 11:
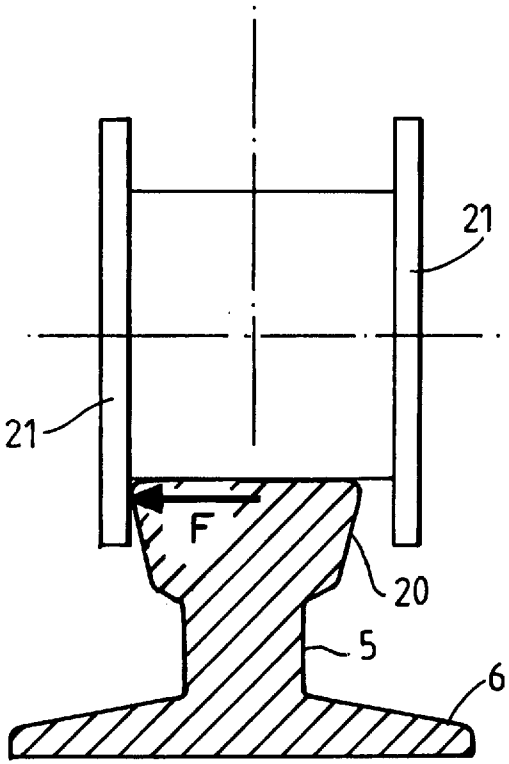

In general terms, each point in this band of contact is less remote from the instantaneous center of rotation i of the rim of the roller on the rail head. The efficiency of each flange 21 in keeping the roller in place on the rail is not thereby modified: the rubbing F of the flange 21 against the lateral face 20 of the rail creates a certain braking force that aligns the roller with the rail by the free pivoting of the roller about a vertical axis. The pivoting P of the roller brings the rim back towards an ideal path along the center line of the head of the rail (see FIGS. 11 and 12).

The guidance system disclosed above requires only a small amount of play between the roller and the rail to avoid jamming of the roller.

What I claim is:

1. Guidance system for guiding along a two-way track a vehicle comprising pneumatically tired steered wheels and a directional arm coupled to the pneumatically tired steered wheels, said guidance system comprising:

(a) a rail consisting of a rolled steel section comprising a head being supported on a web strengthened by a lower foot projecting from each side of the web, said head having a flat top rolling surface extending between two parallel rounded edges and bounded laterally by receding inclined lateral faces, and (b) a grooved roller adapted for floating attachment at an end of the directional arm of the vehicle which is coupled to the pneumatically tired steered wheels, said grooved roller comprising two parallel flanges between which a groove is defined, said groove having a bottom surface rolling on the flat top surface of the head of the rail so that the grooved roller follows the rail.

2. The system of claim 1, in which the lateral faces of the rail are at an angle of inclination to the vertical of between 5° and 15°.

3. The system of claim 2, in which at least one of the lateral faces of the rail has a surface, an upper portion of which is vertical, while a lower portion of said surface is inclined, the said upper and lower portions of the surface being separated by a generatrix parallel to the rail.

4. The system of claim 1, in which at least one of the lateral faces of the rail has a surface, an upper portion of which is vertical, while a lower portion of said surface is inclined, the said upper and lower portions of the surface being separated by a generatrix parallel to the rail.

5. The guidance system of claim 1, in which the rounded edges between which the flat top surface extends have a radius of from 2 to 5 mm.

6. Guidance system for guiding along a two-way track a vehicle comprising pneumatically tired steered wheels and a directional arm coupled to the pneumatically tired steered wheels, said guidance system comprising:

(a) a rail consisting of a rolled steel section comprising a head being supported on a web strengthened by a lower foot projecting from each side of the web, said head having a flat top rolling surface extending between two parallel rounded edges and bounded laterally by receding inclined lateral faces, the said lateral faces are at an angle of inclination to the vertical of between 5° and 15°, and (b) a grooved roller adapted for floating attachment at an end of the directional arm of the vehicle which is coupled to the pneumatically tired steered wheels, said grooved roller comprising two parallel flanges between which a groove is defined, said groove having a bottom surface rolling on the flat top surface of the head of the rail so that the grooved roller follows the rail.

7. The rail of claim 6, which at least one of the lateral faces thereof has a surface, an upper portion of which is vertical, while a lower portion of said surface is inclined, the said upper and lower portions of the surface being separated by a generatrix parallel to the rail.

8. The guidance system of claim 6, in which the rounded edges between which the flat top surface extends have a radius of from 2 to 5 mm.

9. Guidance system for guiding along a two-way track a vehicle having pneumatically tired steered wheels to which a directional arm is coupled, said system comprising:

a) a grooved roller adapted to be floatingly attached at an end of the directional arm, said grooved roller comprising a rim and two parallel flanges between which a groove is defined, b) a rail for guiding the grooved roller, said rail consisting of a rolled steel section comprising a head supported on a web strengthened by a foot portion extending from both sides of the web, said head comprising a flat top rolling surface onto which the rim of the roller roles, said flat top rolling surface extending between two parallel rounded edges, whereby the head is laterally bounded by two lateral faces which are receding inclined so that when a flange of the roller contacts a lateral face of the rail in an area of contact, said area of contact is restricted to a narrow band of contact along and below the rounded edge connecting said lateral face to the flat top rolling surface.

10. The guidance system of claim 9, in which the rounded edges between which the flat top surface extends have a radius of from 2 to 5 mm.

* * * * *